United States Patent [19]

Beck

[11] Patent Number: 4,759,201

[45] Date of Patent: Jul. 26, 1988

[54] WINDING THREAD DEVICE

[76] Inventor: Alfred Beck, Hechinger Strasse 10, Rottenburg-21, Fed. Rep. of Germany

[21] Appl. No.: 33,168

[22] Filed: Mar. 31, 1987

Related U.S. Application Data

[62] Division of Ser. No. 879,526, Jun. 23, 1986.

[30] Foreign Application Priority Data

Apr. 29, 1982 [DE] Fed. Rep. of Germany ..... 3215952

[51] Int. Cl.[4] ..... D04B 9/16

[52] U.S. Cl. ..... 66/135

[58] Field of Search ..... 66/125 R, 132 T, 135

[56] References Cited

U.S. PATENT DOCUMENTS

| | | | |
|---|---|---|---|
| 346,182 | 7/1886 | Ward | 66/135 X |
| 2,204,417 | 6/1940 | Lawson | 66/135 X |
| 2,523,460 | 9/1950 | Wilson | 66/135 |
| 3,785,176 | 1/1974 | Hebbecker et al. | 66/132 T |
| 3,939,671 | 2/1976 | Lawson et al. | 66/125 RX |
| 4,056,239 | 11/1977 | Fecker et al. | 66/132 TX |
| 4,099,389 | 7/1978 | Herbein | 66/135 X |

FOREIGN PATENT DOCUMENTS

| | | | |
|---|---|---|---|
| 155572 | 2/1939 | Austria | 66/125 R |
| 443983 | 1/1949 | Italy | 66/135 |
| 1437287 | 5/1976 | United Kingdom | 66/132 T |

*Primary Examiner*—W. Carter Reynolds

[57] ABSTRACT

An insertion device for inserting a wrap thread in a circular knitting machine having a plurality of knitting needles with hooks. The machine has a plurality of successive knitting systems for the production of patterns extending in the longitudinal direction of a produced tubular fabric. The inserting device has a free end region and a passage for the wrap thread at the free end region. There is further a toothed belt for controlling the movement of the inserting device and a wheel meshing with the toothed belt. The inserting device further comprises a small bar having an upper end firmly connected with the wheel and a lower free end protruding towards the needles.

18 Claims, 18 Drawing Sheets

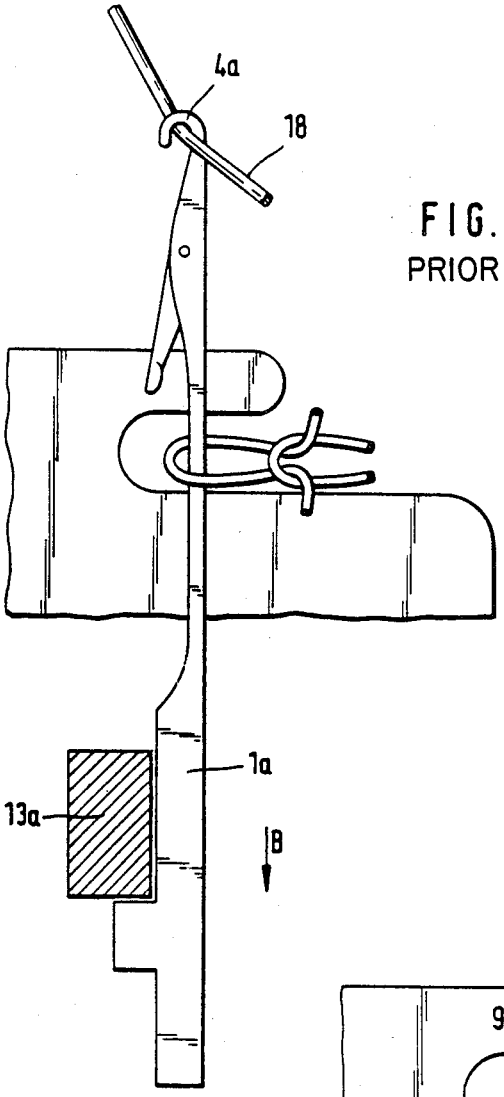
FIG. 10
PRIOR ART
FIG. 11
PRIOR ART
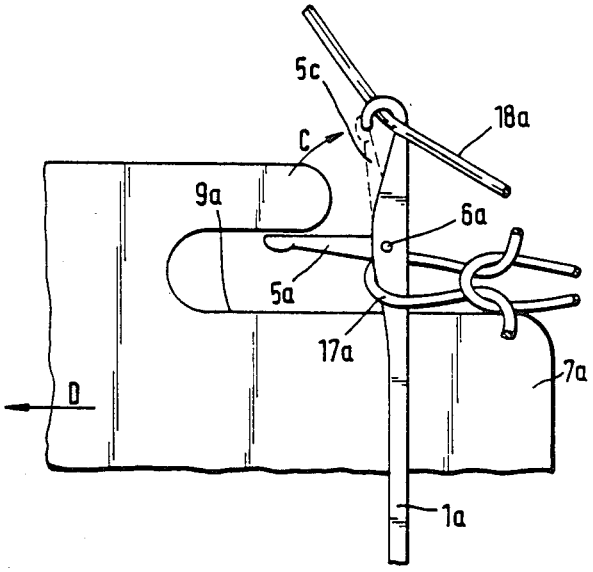

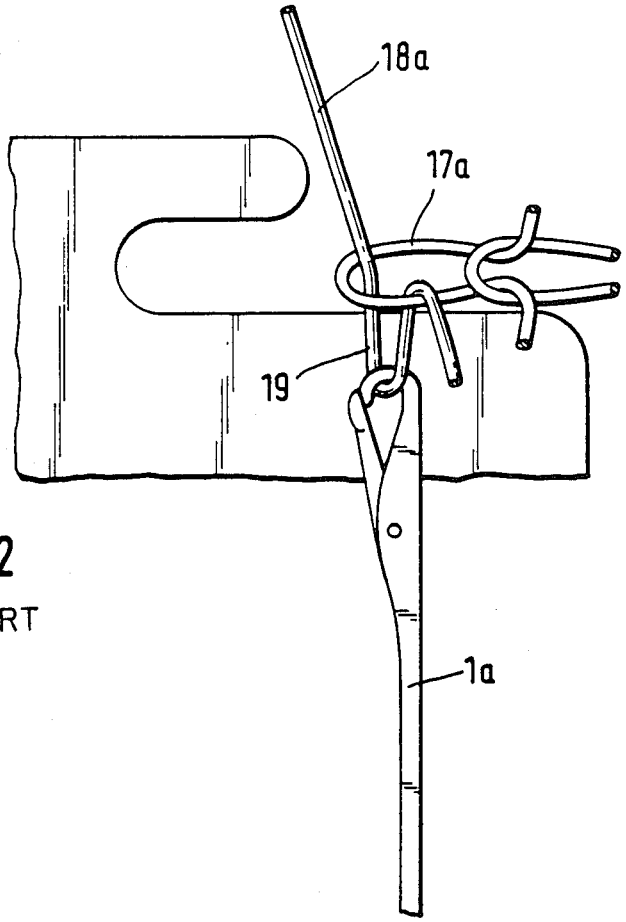
FIG. 12
PRIOR ART
FIG. 13
PRIOR ART
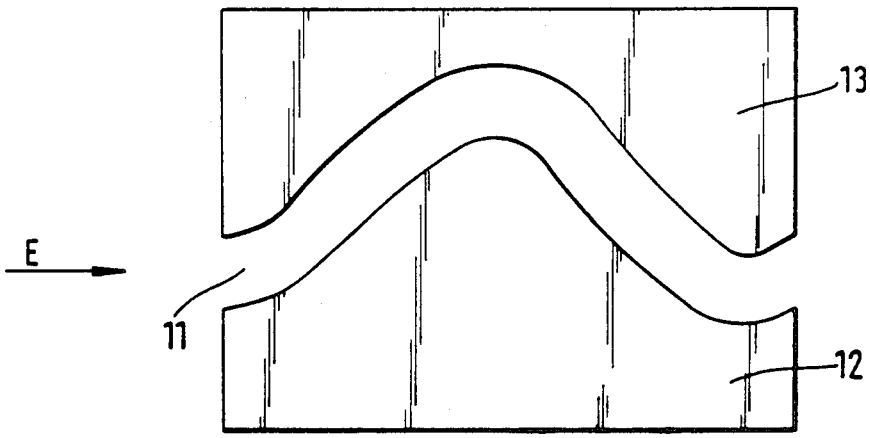

WINDING THREAD DEVICE

This is a division of copending application Ser. No. 879,526, filed June 23, 1986.

The invention relates to a device for inserting a wrap thread in a wrap insertion knitting machine having a center and a plurality of hooked knitting needles in a plurality of successive knitting systems for the production of patterns extending in the longitudinal direction of a produced tubular fabric. The plurality of needles are moving in one direction about the center of the machine.

These devices comprise a number of bore devices arranged above the knitting needles, through which the wrap threads pass in the direction towards inserting devices for the knitting needles. This number corresponds to the number of wrap threads. The bore devices are moving in the same direction as the needles about the center of the machine.

An inserting device is provided for each wrap thread. The inserting device has a free end region with a passage for the wrap thread. A rotating device is provided for each inserting device, and with the passage, is movable over the highest position of needle hooks over an arcuate section. A control device is provided for controlling the movement of the inserting device. And, a displacer arm in some of the knitting systems is positioned between the inserting device and needles situated beneath it and prevents insertion of the wrap thread into needles not to be wound.

Such a device has been previously in public use world-wide. Here it is a matter of a jacquard knitting machine with winding thread introduction. Thus it is possible to produce jersey fabrics having patterns, such as stripes, zig-zag patterns, double stripes, etc. in the direction of wales. These stripes have a slimming effect if in the garment they likewise extend from above downwards. The machines are suitable for example for the production of single jersey fabrics. Due to the possibilities of weft and warp thread knitted interlacings it is possible to produce thick pullover material, dress fabrics with genuine tartan effects, napped linings for children's clothing or linings of novel yarns, both for clothing fabrics and for furnishing fabrics. With such machines it is also possible to produce light clothing fabrics, blouse fabrics and shirtings. The fabrics combine the agreeable qualities of hosiery fabric with the appearance of traditionally woven fabrics.

BACKGROUND OF THE INVENTION

However the initially mentioned device has the following disadvantages:

(a) The winding device is here formed as a horizontally pivotable finger. It must be brought back into the initial position by a coil spring. This coil spring can break.

(b) In the pivoting of the winding finger it is necessary to apply force both to provide the spring stress and to pivot the winding finger. Since the winding fingers must be returned quickly, considerable forces are needed.

(c) The forces are expressed in higher wear of those parts which are necessary for the application of the forces.

(d) The snapping back of the winding fingers causes considerable noise.

(e) The noise is also increased by the guide device which is necessary for controlling the winding fingers.

(f) The winding threads generate fluff, because oscillatory forces, having a saw-tooth course as regards time and tension, act upon them in the eye of the winding finger.

(g) In addition to the eye in the middle finger however, as in a sewing machine brake eyes are necessary on account of the oscillatory saw-tooth movement, in order to keep the winding thread under traction. Therefore the winding thread is unnecessarily subjected to tension stress, breaks sooner and produces fluff for this reason too. These additional brake eyes are an additional expense. Moreover one of these brake eyes must be controlled in upward and downward movement in order thus to some extent to compensate the reciprocating movement of the winding finger as regards thread tension.

(h) In practice the winding thread does not always run in the desired manner around the winding finger. Rather on account of the discontinuous movement it sometimes lays itself several times around the winding finger, and thus the winding thread breaks.

(i) The distance from winding finger to winding finger must be great, on account of their pivot distance. Therefore a small spacing is not possible.

(j) Due to the necessary guide devices, the eye devices and the winding fingers, the machine is very inaccessible at the top, so that it is very difficult to carry out repairs or to effect new settings.

(k) For safety reasons in the case of a 26-inch machine it is possible to knit only at twelve revolutions per minute.

(l) It is not possible for example to provide two parallel lines in the knitted fabric running down from the top and lying close beside one another.

(m) A 26-inch machine has 76 knitting systems and 96 spools, that is the number of spools is considerably greater than the number of the knitting systems.

(n) In practice it is not possible to feed two winding threads at the same time to the same winding finger.

Furthermore a device is known the winding finger of which is rotatable about a vertical axis. Possibly it is rotatable in a range of 360°. It is rotatable by means of a rack and pinion drive and must always be brought back again from the end pivot range. This means that here again there is an oscillatory movement. The winding finger has at its end a distance of 0.5 mm. from the needle bed. With the winding finger no stitches can be formed, but only effect threads can be inserted. It must be ensured that the winding finger does not collide with the needles in the high position. One is not in a position to wind on successive knitting systems. Rather it is possible to wind only on every fourth knitting system. It is also disadvantageous that winding is effected on one occasion with the machine running direction and on the other contrarily thereof. Thus different insertion structures are obtained. In one oscillation cycle the machine must be overtaken, which is unfavourable, while it is possible to work contrarily of the machine running direction only in the second oscillation cycle.

OBJECT AND STATEMENT OF THE INVENTION

It is the problem of the invention to indicate a device of the initially stated kind with which it is possible to wind both more quickly and more securely, which at the same time produces less fluff in comparable cases, and with which it is possible to pattern with quite substantially more variability.

In accordance with the invention this problem is solved by the following features:

(a) each of the bore devices comprises a hollow shaft, the geometrical longitudinal axis of which is aligned from above with the needles, (b) the rotating device comprises a wheel constantly rotating in a single direction guided by the hollow shaft, the wheel being rotated without slip by the control device, (c) the inserting device for each wrap thread comprising a small bar having an upper end firmly connected with the wheel and a lower free end protruding towards the needles, (d) the lower free end having means defining the passage, situated at a lateral distance from the geometrical longitudinal axis of the hollow shaft. And (e) viewed towards the center of the machine, the direction of rotation of the wheels and the inserting devices connected to them is opposite to the direction of movement of the needles about the center of the machine.

Thus it is possible to knit at 21 to 18 revolutions per minute, instead of twelve revolutions per minute, in practice. On account of the uniform stressing it is possible to use thinner winding threads or winding threads of quite different properties. The invention also renders it possible readily to make the winding thread from metal, which could then act as heating wire in heatable underclothing or the like. These winding threads of metal could be placed so closely that a Faraday cage is formed, or to knit in an antenna. The device is also very well suited to the working of "Lurex" material. It is easily possible to arrange the device to lead or to lag. The adjustment is simple and requires no apparatus expenditure, because it is simply necessary to look from beneath through the hollow shaft at the needles. The thread tensioner for the winding thread can be set to a constant minimum tension. Therefore the winding thread has to withstand little traction. The construction of the device is very simple, its synchronisation is very simple, and the parts require comparatively low tolerances.

DESCRIPTION OF THE DRAWINGS

Examples of embodiment of the invention will now be described below. In the drawing:

FIGS. 1–14 depict Prior Art

FIG. 1 shows a cross-section through stitch-forming elements,

FIG. 2 shows the front of stitches,

FIG. 3 shows the rear of stitches,

FIG. 4 shows the front of a wale,

FIG. 5 shows the rear of a wale,

FIG. 6 shows the rear of a stitch row,

FIG. 7 shows the front of a stitch row,

FIG. 8 shows stitch-forming parts in a specific working position,

FIG. 9 shows a detail of FIG. 8 in a further working position,

FIG. 10 shows a third working position,

FIG. 11 shows a fourth working position,

FIG. 12 shows a fifth working position,

FIG. 13 shows the view of a cam part,

FIG. 14 shows two cam parts with the needles controlled by them,

The prior art will now be described with reference to FIGS. 1–14.

DESCRIPTION OF THE INVENTION

Prior art knitting machines are described with reference to FIGS. 1–14. The present invention is then described with reference to FIGS. 15–29.

Figure 1:
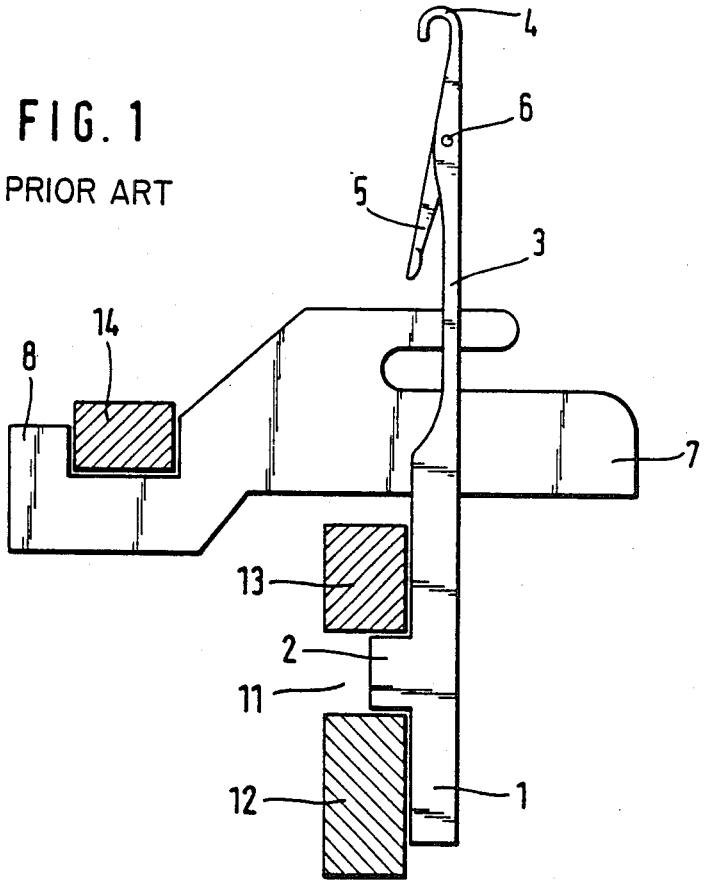
FIG. 1 PRIOR ART

According to FIG. 1 the one latch needle 1 consists of the shank 3, the needle foot 2, the needle hook 4 and the latch 5 mounted on the hinge 6. Between each two latch needles 1 a knock-over sinker 7 is mounted, and again between each two knock-over sinkers 7 a latch needle 1 is provided for upward and downward movement. In this progressive sequence the latch needles 1 and the knock-over sinkers 7 are arranged in a circle, so that due to the needle movements a progressive tubular knitted fabric is produced. In the operation of knitting the latch needle 1 carries out an upward and downward movement and the knock-over sinker 7 carries out a reciprocating movement in the horizontal direction. The latch needles 1 arranged in a circle (the centre of the circle lying on the right in FIG. 1) and the knock-over sinkers 7 are mounted in known rings (not shown in FIG. 1) with slots in which the latch needles 1 carry out their upward and downward and reciprocating movements. The slotted rings, the needle cylinder for the latch needles 1 and the ribbed disc for the knock-over sinkers 7 are rotatably mounted, and in working rotate about the geometrical central axis of the machine.

The expeller part 12 and the knock-over part 13 form the cam channel 11 in which the needle foot engages. The parts 12 and 13 are mounted non-rotatably, that is fast with the machine, so that in the rotation of the needle cylinder (not shown) the needle foot 2 must run along in the cam channel. By appropriate shaping of the expeller part 12 the latch needle 1 receives its upward movement, and from the knock-over part 13 its downward movement, in the rotation of the needle cylinder.

The knock-over sinker 7 receives its reciprocating movement from the sinker eccentric 14, which is likewise non-rotatably mounted, and engages in a recess on the right of the sinker foot 8, Corresponding movements of the latch needles 1 and of the knock-over sinkers 7 render possible the operation of knitting in tubular form.

Figure 2:
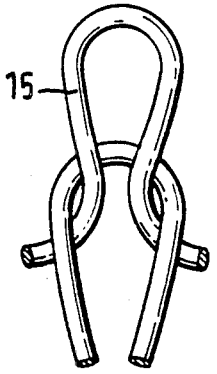
FIG. 2 PRIOR ART
Figure 3:
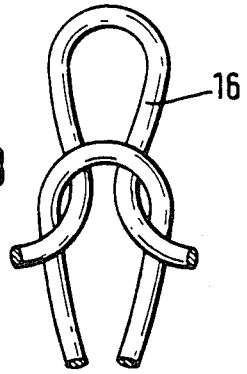
FIG. 3 PRIOR ART

The stitches then produced have a front, which is called right side and is represented in FIG. 2, and a left side which is represented in FIG. 3. The right side can be recognized from the stitch legs 15 which are drawn through from rear to front, and the left stitch side from the stitch legs 16 which are drawn through from front to rear. The tubular knitted fabric hanging on the needles always displays right stitches on the outer side and left stitches on the inner side.

Figure 4:
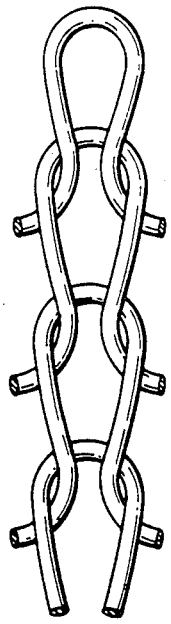
FIG. 4 PRIOR ART
Figure 5:
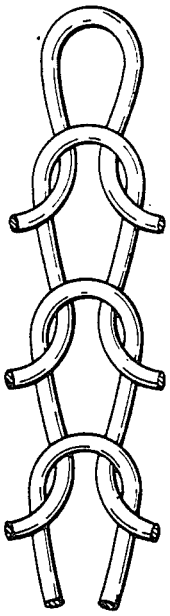
FIG. 5 PRIOR ART

The stitches of the tubular knitted fabric are linked to one another in horizontal and vertical directions. FIG. 4 shows a right-side wale, consisting of right stitches linked over one another, and FIG. 5 shows a left-side wale consisting of left stitches linked over one another. The linking of stitches to one another in horizontal direction produces stitch rows.

Figure 6:
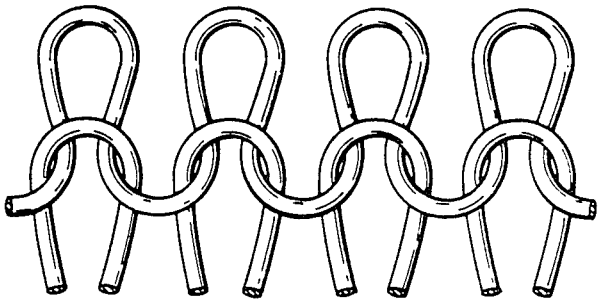
FIG. 6 PRIOR ART
Figure 7:
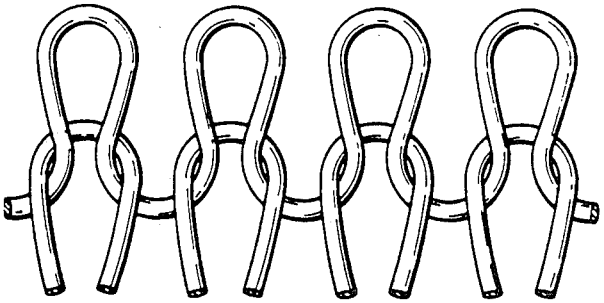
FIG. 7 PRIOR ART

FIG. 6 shows a left-side stitch row and FIG. 7 a right-side stitch row. Wales are always formed by the same needle, whereas stitch rows are produced by needles arranged side by side.

The stitch formation presumes that a new stitch can be formed only if an old stitch is hanging on the needle.

Figure 8:
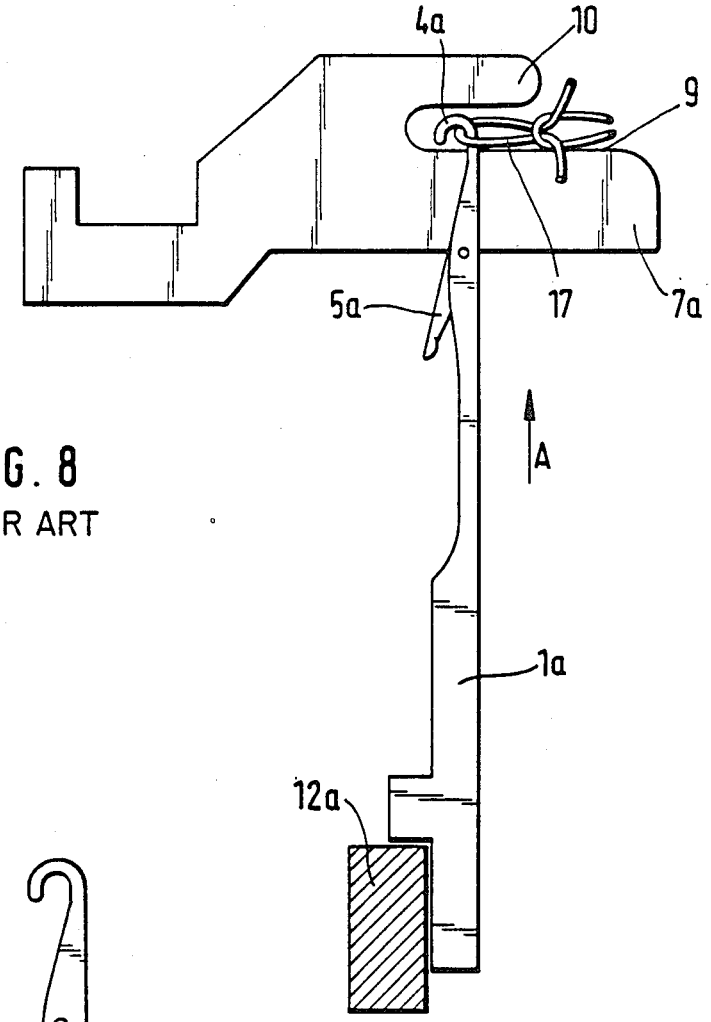
FIG. 8 PRIOR ART

FIG. 8 shows the knock-over sinker 7*a* and a latch needle 1*a* with a stitch hanging in the needle hook 4*a*.

In the stitch formation the latch needle 1*a* is lifted by the expeller part 12*a* in the direction of the arrow "A". The sinker nose 10 here has the task of holding the old stitch down, so that it remains at the level of the knock-over edge 9.

Figure 9:
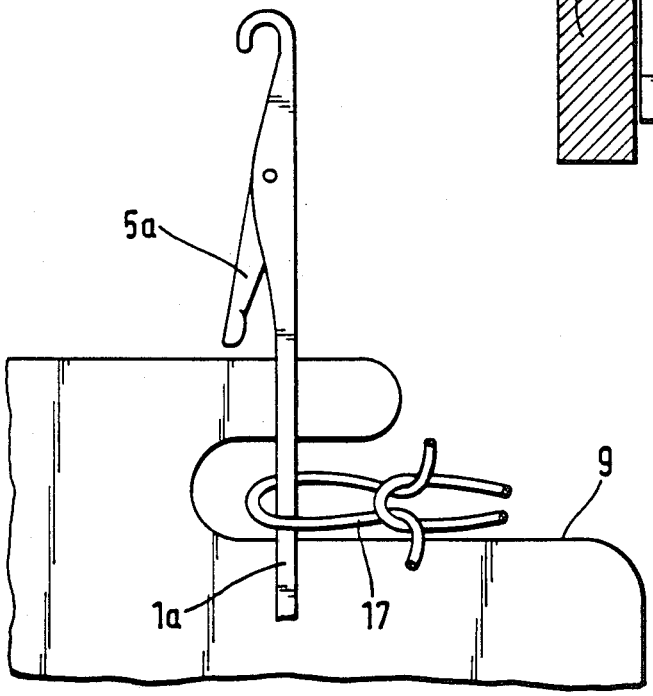
FIG. 9 PRIOR ART

The upward movement of the latch needle 1*a* is ended when the old stitch 17, situated on the knock-over edge 9, is situated beneath the latch 5*a*. This position is illustrated in FIG. 9 and will be called latch-clearing position.

Next the latch needle 1*a* is drawn downwards by the knock-over part 13*a* in the direction of the arrow "B", as represented in FIG. 10. In the downward movement a new thread 18 is laid into the needle hook 4*a* and drawn downward therewith in the downward movement. The old stitch 17*a* held on the knock-over edge 9*a* in the downward movement of the latch needle 1*a* closes the latch 5*a*, rotating on the hinge 6*a*, in the direction of the arrow "C" into the chain-line position of the latch 5C. The thread 18*a* is thus completely enclosed and by further drawing down of the latch needle 1*a* it is drawn through the old stitch 17*a*, and thus the new stitch is formed.

In this operation the knock-over sinker 7*a* has been drawn to the left in the direction of the arrow "D", so that the operation of stitch formation can take place on the knock-over edge 9*a*.

According to FIG. 12 the new thread 18*a* is drawn through the old stitch 17*a* and thus the new stitch 19 is produced. Thereupon the latch needle 1*a* is guided upwards again in order to collect a new thread and in the same cycle to form a new stitch.

Each newly added thread gathered by the needles in row arrangement is formed into a stitch row. The consequent knitted fabric has stitch for stitch the same appearance and has no pattern character of any kind. This type of knitting is simple in production and renders possible a high productivity.

The upward and downward movement of the needles by the expeller part 12 and the knock-over part 13 (FIG. 1) can also be seen from FIG. 13. The two parts 12 and 13 form the cam channel 11 in which the needle foot 2 slides along and imparts the necessary movement to the latch needles 1 for the stitch formation. The needles run along in the direction of the arrow "E".

The working in of a stitch of different colour in place of a basic stitch always appearing in the same colour is known and is achieved in a manner in which an additional thread is not laid along the needle row but is laid around the individual needle corresponding to the pattern, and then is knitted. Thus a coloured stitch appears in the basic knitted fabric at a point determined according to pattern. The thread necessary for this purpose proceeds in the longitudinal direction of the tubular knitted fabric.

The laying of the thread around the needle selected according to pattern can take place according to the prior art in two different manners, namely:

1. By an inserter finger which feeds the additional thread by reciprocating movement only to the selected needle intended for patterning and 2. By spring-loaded inserter fingers which by striking upon a stationary eccentric carry out a swinging movement and in doing so feed the thread of different color to the selected needle intended for patterning.

In both principles great expenditure of mechanism and space is necessary. The reciprocating movement of the inserter fingers requires twice as much space as the guidance of the needles according to FIG. 13 for the production of one stitch per needle.

In the present invention the working-in of a stitch of different colour is achieved in that a winding finger or the like lays the thread brought for the stitch through 360° around the selected needle and forms it into the stitch at the point where a stitch is absent in the basic knitted fabric. The circular movement of the winder takes place in synchronisation with the upward and downward movement of the needle in stitch formation. Due to the circular movement of the winder it is possible to increase the production by 100% in as much as in conventional principles the mechanism for the production of a wound stitch requires the space where two normal basic stitches were formed, and according to the present invention only the space required for the production of a single normal basic stitch is necessary.

The advantage of the winder finger or the like according to the invention over the inserter finger is that its circular movement can be carried out faster than the reciprocating movement of the inserter finger which due to eccentrics with steep curves results in a low working speed.

In advance of the following explanation of the invention it should be said that it is of course also possible to effect the needle selection of the needles used for patterning by every known pattern device, such as stationary selector devices, rotating pattern wheels, steppable pattern drums, rotating punched steel tapes, computer-controlled electronic selection devices or the like.

Figure 14:
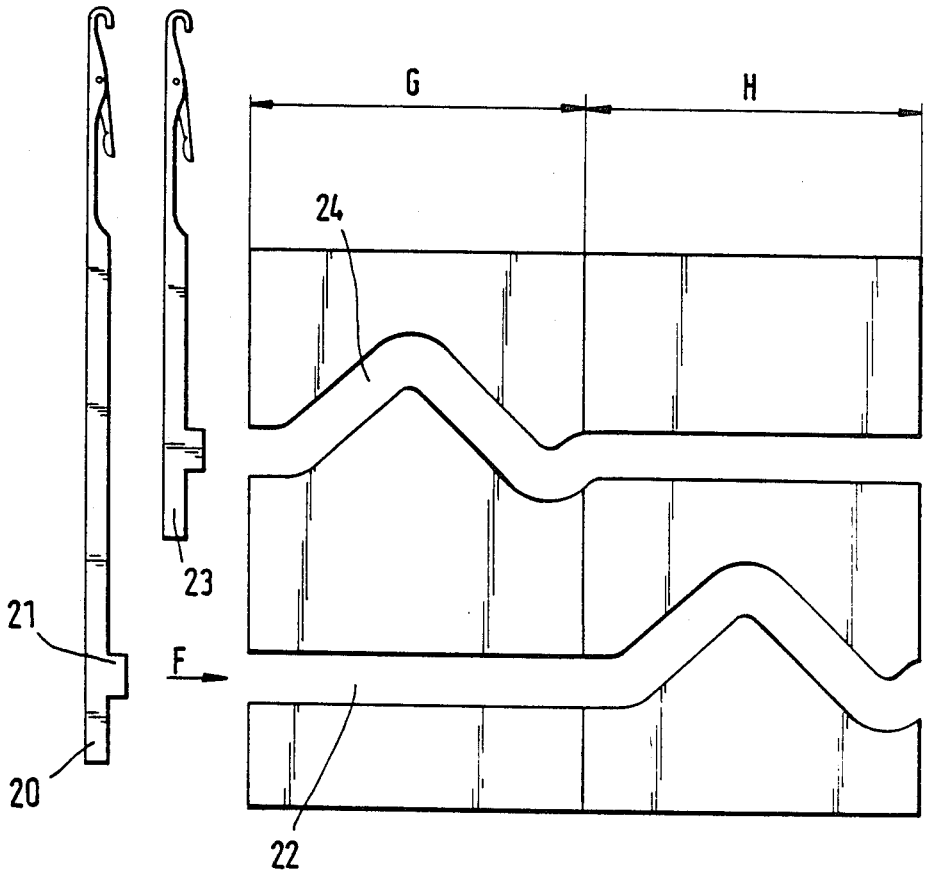
FIG. 14 PRIOR ART

FIG. 14 shows the simplest principle of a needle selection with two different needle types on two knitting systems lying one behind the other. Two different needles are used, namely long needles 20, the feet 21 of which slide along in the lower cam channel 22 and there carry out their knitting movement for the stitch formation, and short needles 23 which receive their knitting movement in the upper cam channel 24.

In FIG. 14 the needles travel through the cam in the direction of the arrow "F" from left to right.

When the short needles 23 have travelled through the section "G" they are compelled by the upper cam channel 24 to make an upward and downward movement and in doing so to form stitches.

Long needles 20, the feet 21 of which slide along in the lower cam channel 22, remain in the rest position in the section "G" and also form no stitches.

In the subsequent knitting system of the section "H" a knitting movement is imparted to the long needles 20 and the short needles 23 remain in the rest position and form no stitches.

On the knitting machine there are present as many winding fingers or the like as the machine has knitting systems. The knitting systems are arranged stationarily and in a circle around the machine. The expeller parts 12 and the knock-over parts 13 are screwed to the interior and form the cam channel 11 as represented in FIG. 1 or the lower cam channel 22 and the upper cam channel 24 as represented in FIG. 14.

The latch needles 1 are mounted in rotating rings with slots so that the latch needles 1 can carry out their upward and downward movements due to the upper and lower cam channels 22 and 24. Thus the latch needles 1 are constantly in rotating movement together with the needle cylinder, and carry out the upward and downward movements for the knitting operation.

The winding fingers are mounted on a disc rotating in synchronism with a needle cylinder. Thus they run at the same speed and in the same direction of rotation around the stitch.

Figure 15:
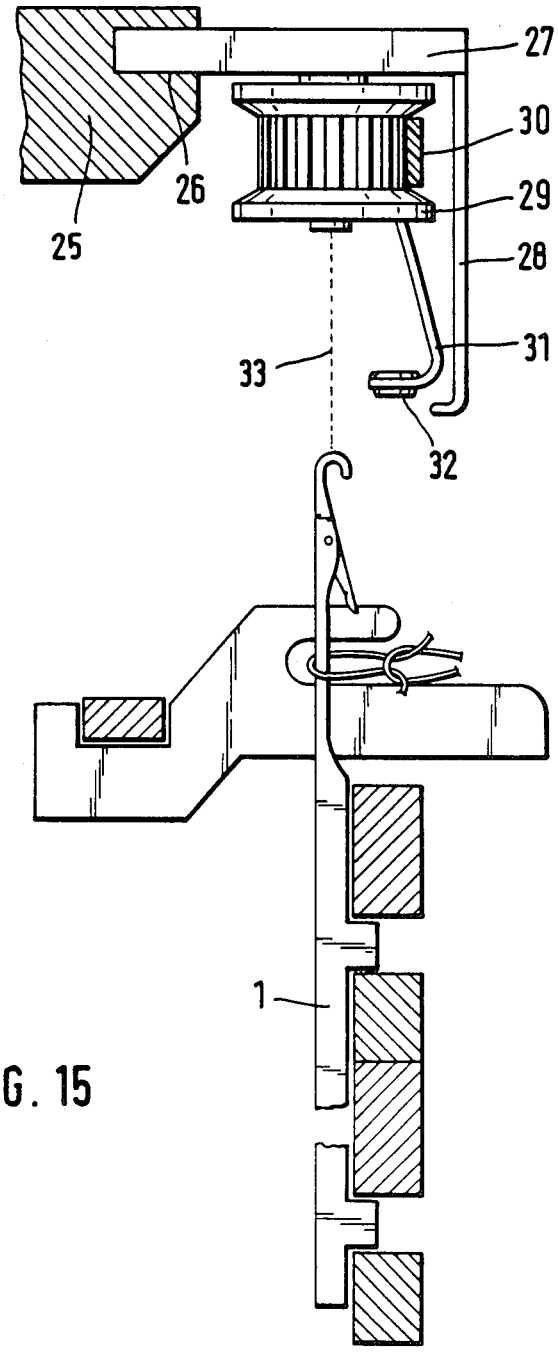
FIG. 15 shows a view of the invention in the circumferential direction.

FIG. 15 shows a cross-section through a knitting system and the main parts.

The disc 25 is provided with an annular groove 26. The holders 27 are secured in this groove and can be positioned by predetermined holes in exactly the same position as the knitting systems. The holder 27 is provided on the right with a securing arm 28 which serves so that any toothed belt 30 which has become loose cannot fall downwards into the needle section, and also to avoid the toothed belt 30 running around the machine entirely without protection against contact.

Figure 15A:
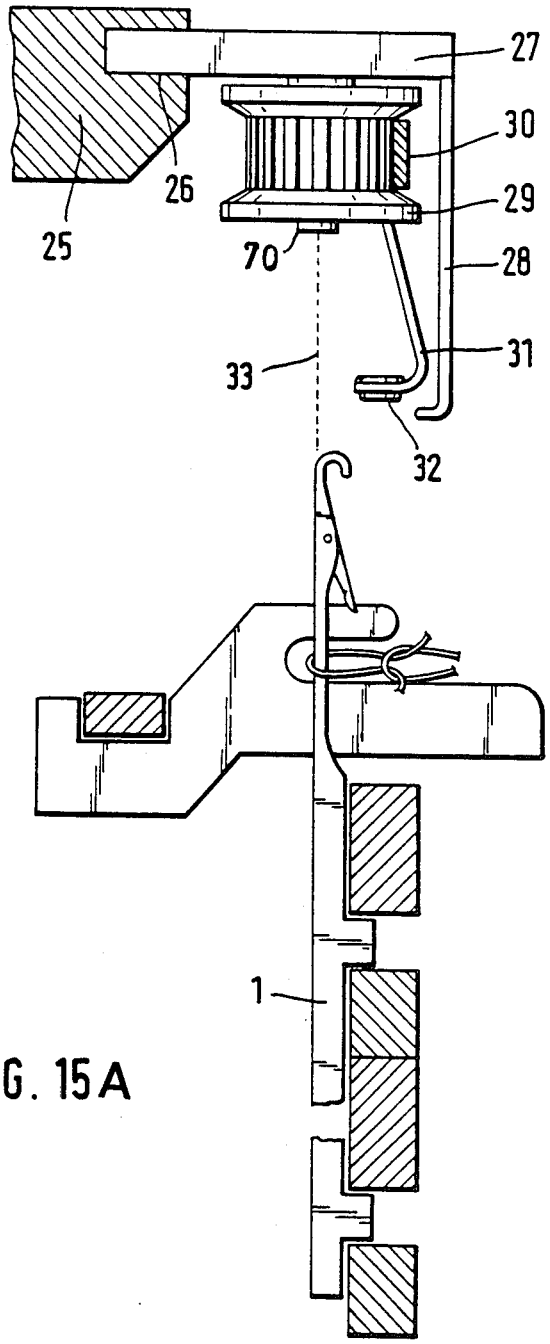
FIG. 15A shows a view substantially similar to FIG. 15, with the axis of the hollow shaft aligned with the needle back.

The toothed wheel 29 has on its under side an eccentrically seated winding finger 31 with a thread guide eye 32 of ceramic material situated on the end. The middle of the toothed wheel 29 coincides in each case with the centre of the chain line 33, which according to the drawing is also the centre of the passing needles. A still better arrangement is obtained if the chain line 33 is aligned with the rear of the latch needle 1 as shown in FIG. 15A. In either case, the geometrical longitudinal axis of the hollow shaft in the toothed wheel 29 is vertical and aligned with the axes of the needles. The geometric longitudinal axes 33 of the wheels 29, extending from the holders 27 secured to the disk 25, all lie in one common circular cylinder. The winding finger or wrap inserting device 31 is a small bar made of a steel wire or a fine casting.

Since the latch needles 1 together with the disc 25 have the same direction of circulation and are synchronised with one another, the possibility exists of laying a thread with the winding finger 31 around a selected needle and forming a stitch.

The toothed belt 30, which runs around the whole machine and sets all toothed wheels 29 together with their winding fingers 31 in rotating movement, is in a ratio to the system number such that the winding finger 31 carries out one full revolution when the disc 25 has travelled the distance "G" or "H" (FIG. 14). Thus the number of revolutions of a winding finger 31 always corresponds exactly to the number of the knitting systems. This has the advantage that the insertion of a winding finger thread can take place on one single system and that the winding finger with its holder 27 can be shifted in the circumferential direction to any desired point and fixed over any desired system. Thus the possibility of a multiplicity of patterns is appreciably increased, since in known principles the wrapping fingers together with their mechanism are fixed in position and require the distance of a knitting system "G" in FIG. 14 for the forward movement and likewise the distance of a knitting system "H" in FIG. 14 for the return movement.

Thus in the known device the distance over two knitting systems was necessary in order to insert a winding thread into a selected needle and form it into a stitch. In addition it was also necessary to use special cam parts on two knitting systems lying one behind the other, rendering it possible to hold the needles in the upper position until the wrapping finger has completed its eccentric-controlled movement and has given the needle the opportunity to form a stitch. This additional space requirement of a whole knitting system is lost to the actual production quantity, which is not the case with the present invention.

Figure 16:
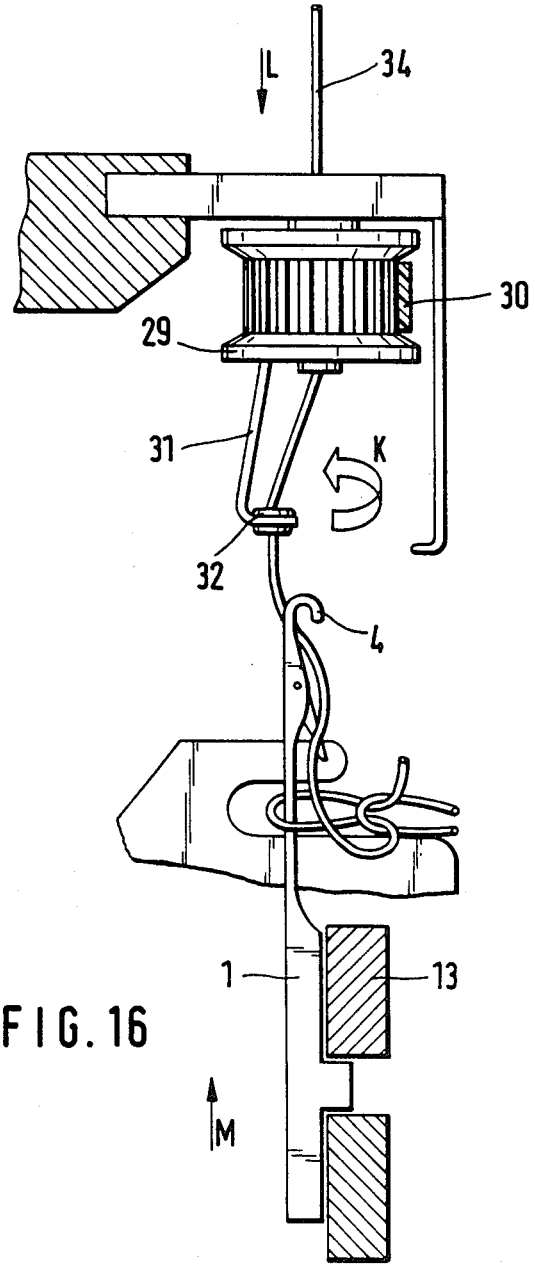
FIG. 16 shows a view like FIG. 15, but with winding thread.

FIG. 16 shows the insertion of a winding thread into a needle predetermined for it. The winding thread 34 comes from above and runs downwards in the direction of the arrow "L" through the hollow shaft 70 of the toothed wheel 29 and then through the thread guide eye or passage 32. Due to the toothed belt 30 and the synchronisation with the machine the latch needle 1 moves upwards in the direction of the arrow "M" and the winding finger 31, seen from above, moves in the counter-clockwise direction "K". The winding thread 34 is thereby laid around the latch needle 1 and comes into the needle hook 4. Due to the further rotation of the winding finger 31 the winding thread 34 comes wholly around the latch needle 1 and in the downward movement caused by the knock-over part 13, forms an additional stitch.

Figure 17:
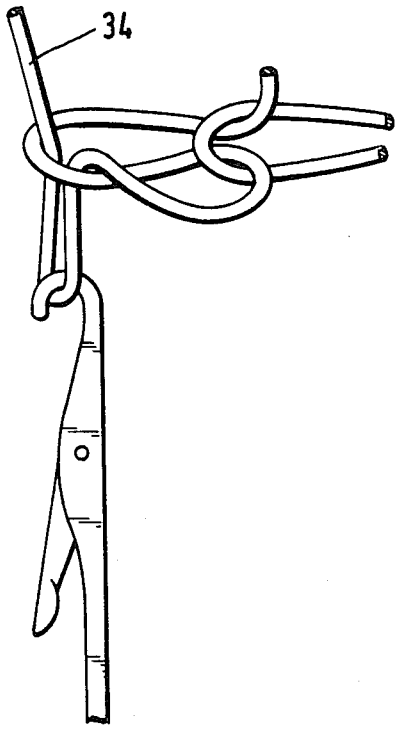
FIG. 17 shows an enlarged detail view of FIG. 16, to clarify the stitch formation.

FIG. 17 shows how the new thread 34 was drawn through the stitches previously situated on the needle, and thus a new stitch is produced.

The toothed wheel 29 and the toothed belt 30 can render possible a high rotation speed of the winding finger 31 and thus a high knitting speed of the machine. This is a quite considerable advantage and cannot be achieved by machines which control their wrapping fingers by eccentrics.

Moreover due to the fact that no production-reducing special cam parts are necessary and also due to the fact that the winding fingers can be allocated to every knitting system according to choice, not only simple operation but also an extended patterning are possible with the machine.

By way of example it is possible to feed a winding thread to the needles selected according to pattern, with a different thread colour, on each of three knitting systems lying one behind the other. These threads can be laid around several needles at the same time, or singly. The winding thread running in the longitudinal direction in the tubular knitted fabric can run in zig-zag from one wale to that beside it or to the wale next but one.

Figure 18:
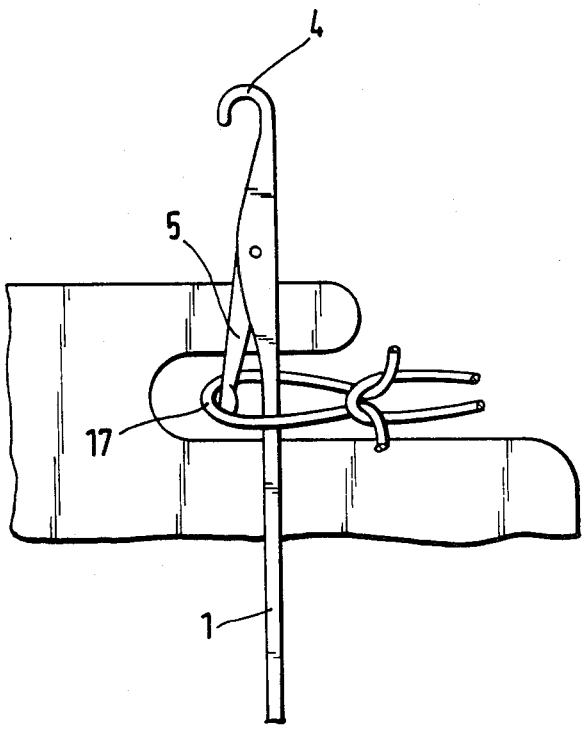
FIG. 18 shows a phase lying in time after FIG. 17.

It is also possible to feed the winding thread to a selected needle which has been raised not into the latch-clearing position (FIG. 9) but into the tuck position. Such a needle position is illustrated in FIG. 18 and shows that the upwardly guided latch needle 1 still has the old stitch 17 lying on the latch 5. In this position the winding thread is laid around the needle and then into the needle hook 4. In the pulling down of the latch needle 1 then the winding thread in the form of a lug unites itself with the old stitch 17. Thus a plaiting of the old stitch 17 by a winding thread of another colour occurs. This plaiting operation can also take place in combination with a winding thread stitch.

Due to the fact that a winding finger 31 is allocated to each knitting system, the winding threads would be taken up and shaped into stitches by practically all needles. Since however this is reserved only for the pattern system, on the other production systems the winding thread must be hindered by a displacer arm 35 from thread insertion. In this case during the circular movement of the winding finger the winding thread is held back behind the needles and cannot be worked into a stitch.

In the example of embodiment according to FIGS. 20 to 25 one may see the holder 27, also the hollow shaft 36 which has a coaxial through-passing bore 37, is circular-cylindrical and is mounted axially non-displaceably but rotatably in a bore of the holder 27. As in FIGS. 15, 16 and 19 here, again a toothed wheel 29 is present the vertically extending teeth of which mesh with a toothed belt. In contrast to the first example of embodiment here the winding finger is not formed essentially from a bent steel wire. Rather here a winding tube 38, which is the inserting device, is connected to one end like a basket device beneath the toothed wheel 29, coaxially with the geometrical central axis 33 of the hollow shaft 36 and protrudes towards the needles. According to the 2:1 FIG. 24, at a short distance from the lower end face 39 a bore or passage 41 is provided the geometrical longitudinal axis 42 of which points obliquely upward at an acute angle in the direction towards the through-passing bore 37. Here the winding thread 34 comes from above through the bore 37, then passes into the winding tube 38, traverses the bore 41 and then can be inserted into the needle hook 4. So that access may be had to the bore 41, in the winding tube 38 opposite to the bore 41 an incision 43 is provided the configuration of which is similar to that of a flute, has upwardly rising flanks, cuts into about ¾ of the diameter (FIG. 24), but with its end face 44 is at a distance from the likewise radially proceeding end face 39, so that a continuous ring 46 remains at the level of the bore 41. The advantage of the second form of embodiment over the first form of embodiment is that it is completely impossible for the winding thread 34 to catch anywhere, which could be possible in extreme cases with the thread guide eye 32.

Figure 21:
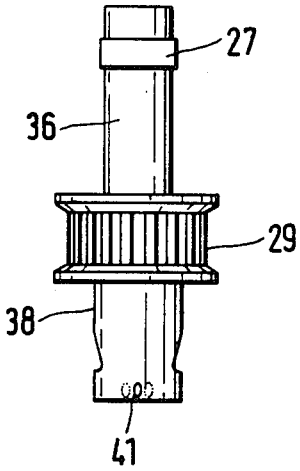
FIG. 21 shows the rear of FIG 20.
Figure 22:
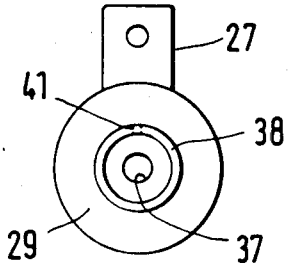
FIG. 22 shows the under side of FIG. 20.
Figure 23:
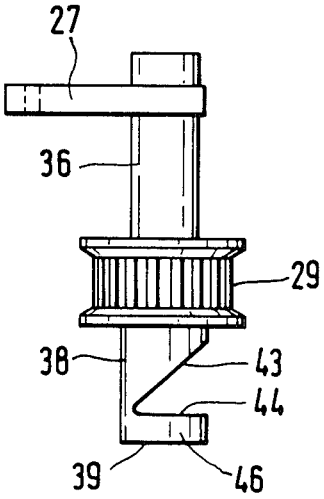
FIG. 23 shows the side view of FIG. 20.

The second form of embodiment also renders it possible to use two or even more winding threads in that—as shown in dotted lines beside the bore 41 in FIG. 21—still more bores are provided. The threads thus guided do not hinder one another.

Figure 24:
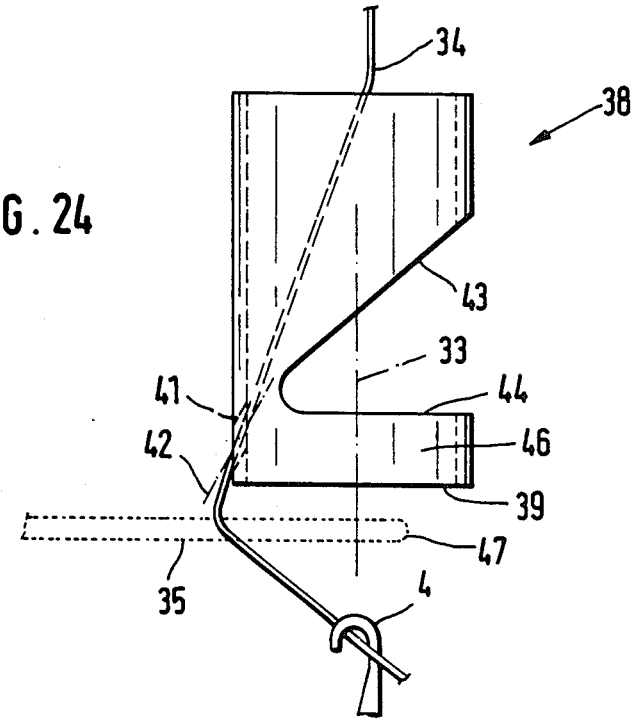
FIG. 24 shows a view similar to FIG. 23, but in pure side view and without the toothed wheel, but with displacer arm entered in dotted lines.
Figure 25:
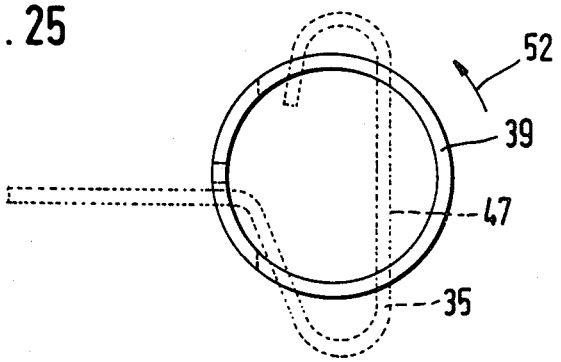
FIG. 25 shows the plan view of FIG. 24.

FIGS. 25 and 24 also show how a displacer arm 35 is to be arranged if the thread is not to be inserted. The displacer arm 35 always lies above the highest position of the needle hook 4. If the displacer arm is present, the winding thread 34 cannot run as shown by FIG. 24. Rather the winding thread 34 would be repelled on the edge 47 and would then remain considerably to the right of the needle hook 4.

Figure 19:
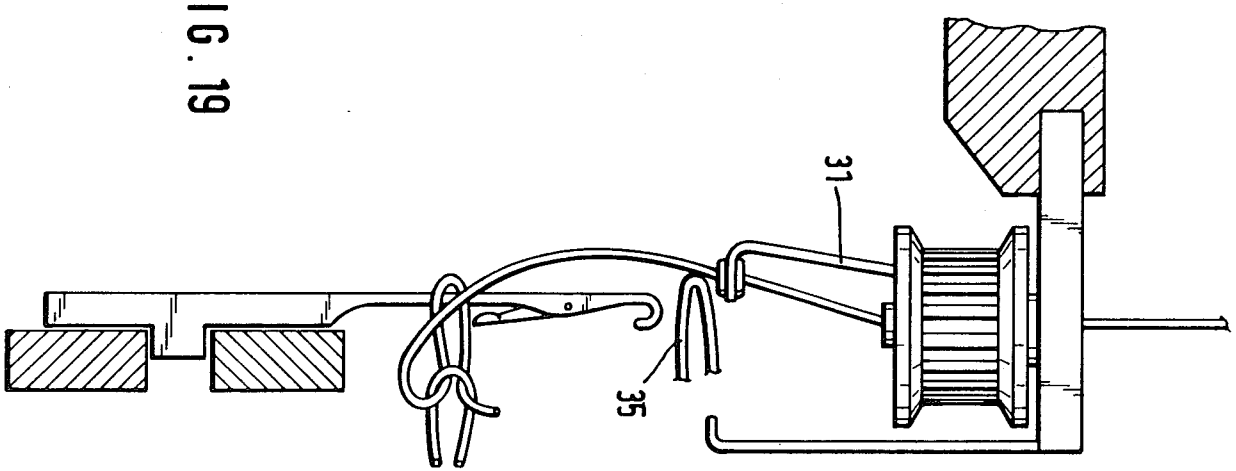
FIG. 19 shows an illustration like FIG. 16, but with displacer arm.
Figure 20:
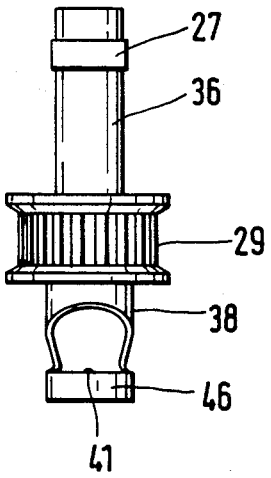
FIG. 20 shows a first view of a winding tube according to a second embodiment of the invention.
Figure 24A:
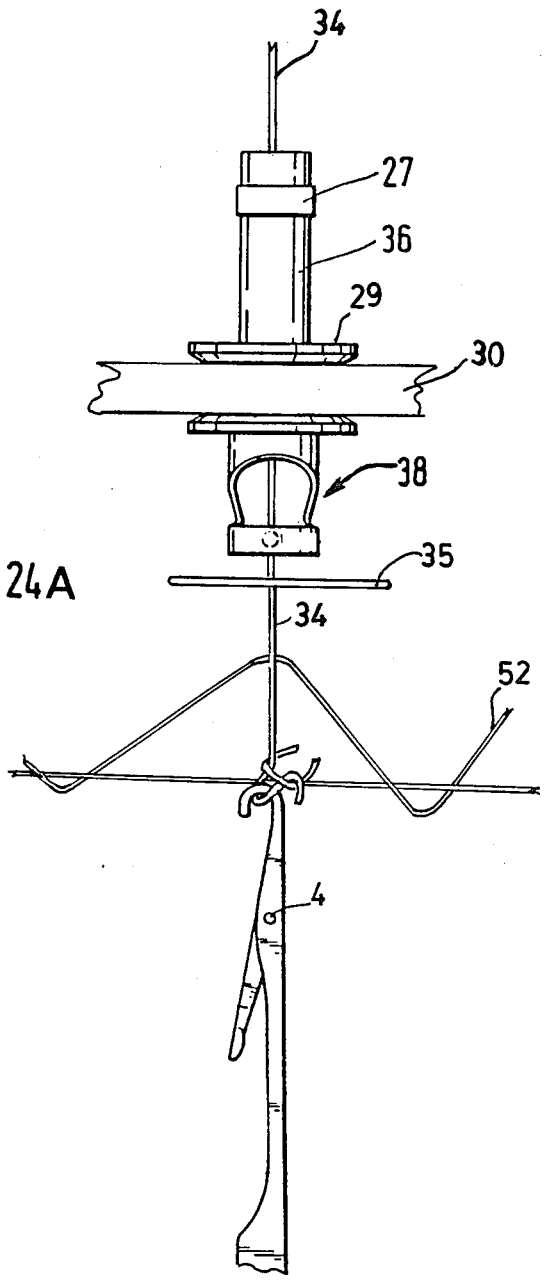
FIG. 24A shows a side view of FIG. 24.

FIG. 24A shows the manner in which the displacer arm 35 guides the winding thread connected to holder 27, as shown in FIG. 19. The holders 27 and the displacer arms 35 are in a fixed position relative to each other. After the fabric designer has designed a cloth, for example, according to FIG. 29, the machine operator knows which winding tubes 38 should be disabled. Displacer arms 35 are fastened to the holders 27 at those places. Sometimes, no winding tubes 38 will be disabled in accordance with the dictates of the design and no displacer arms 35 will be used.

Figure 26:
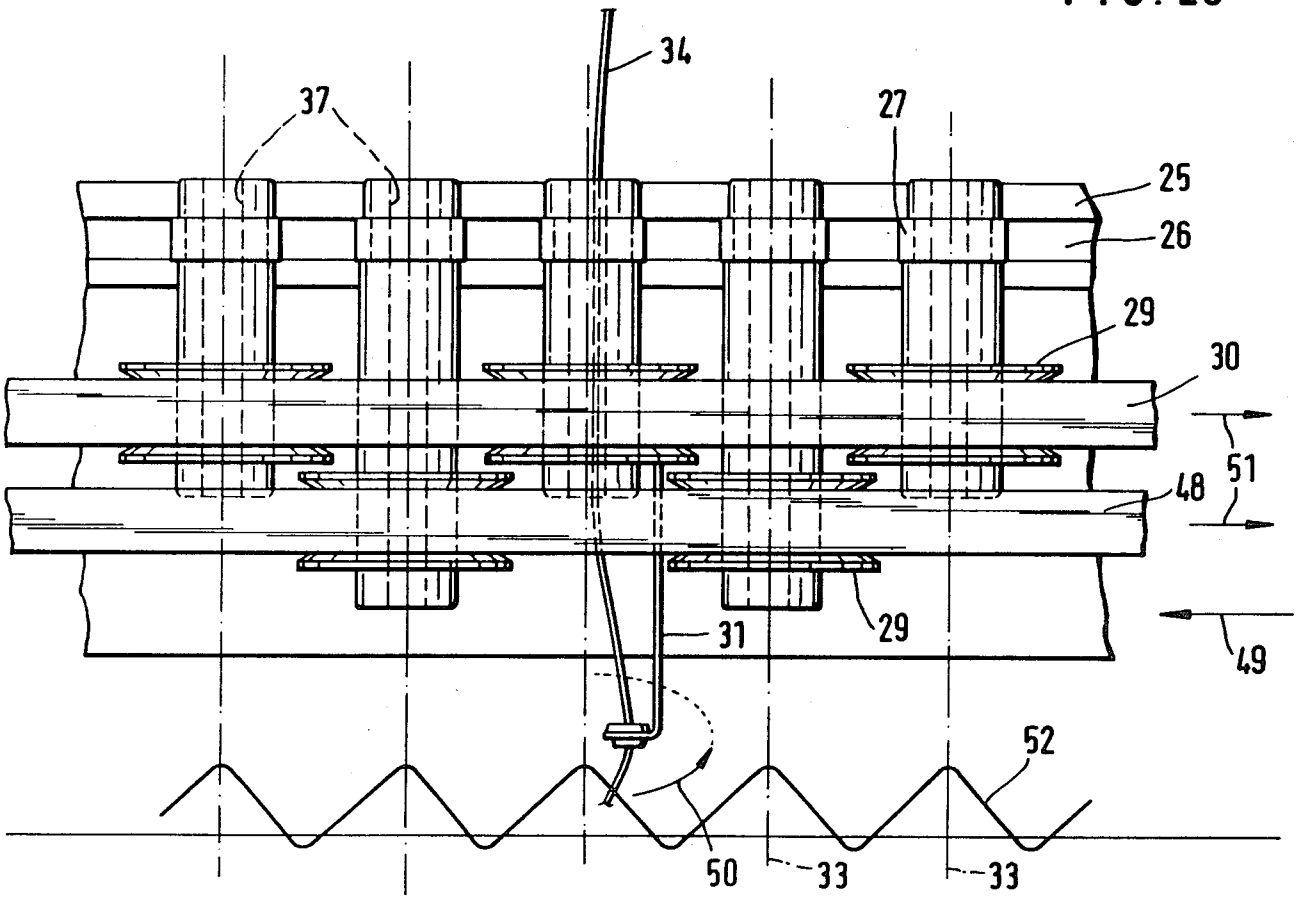
FIG. 26 shows the external view of the control device with hollow shafts and toothed wheels in staggered arrangements and with a winding finger, and the course of the needle hook according to a third embodiment of the invention.

FIG. 26 shows the possibility of staggered arrangement according to a third embodiment of the invention. The disc 25 with the annular groove 26, in which the holders 27 are screwed fast, may be seen. This provides a common assembly base for the hollow shafts 36. Every second hollow shaft is longer than every first hollow shaft, namely by such a distance that the toothed wheels 29 just do not contact one another in the horizontal direction. In addition to the toothed belt 30 now for the toothed wheels 29 situated on the long hollow shafts a toothed belt 48 is used. Both toothed belts 30, 48 have the same tooth pitch and circulate at the same speed. Here the disc 25 moves in accordance with the arrow 49, the belts in accordance with the arrows 51, the winding fingers 31 in accordance with the arrow 50, and the needles naturally also in accordance with the arrow 49. The zig-zag line 52 here shows the movement of the needle hooks. The spacing of the vertical dot-and-dash lines 33 is equal to one knitting system, and they point to the highest position of the needle hooks 4. As can easily be seen, the hollow shafts are adjustably secured through disc 25 to a common base and all the winders can be set to lead or lag in a simple manner in that the disc 25 which is secured to a common assembly base, is turned a little to the left or right simply, according to FIG. 26. Thus it is easy to influence at what moment exactly the insertion operation is to take place.

Figure 27:
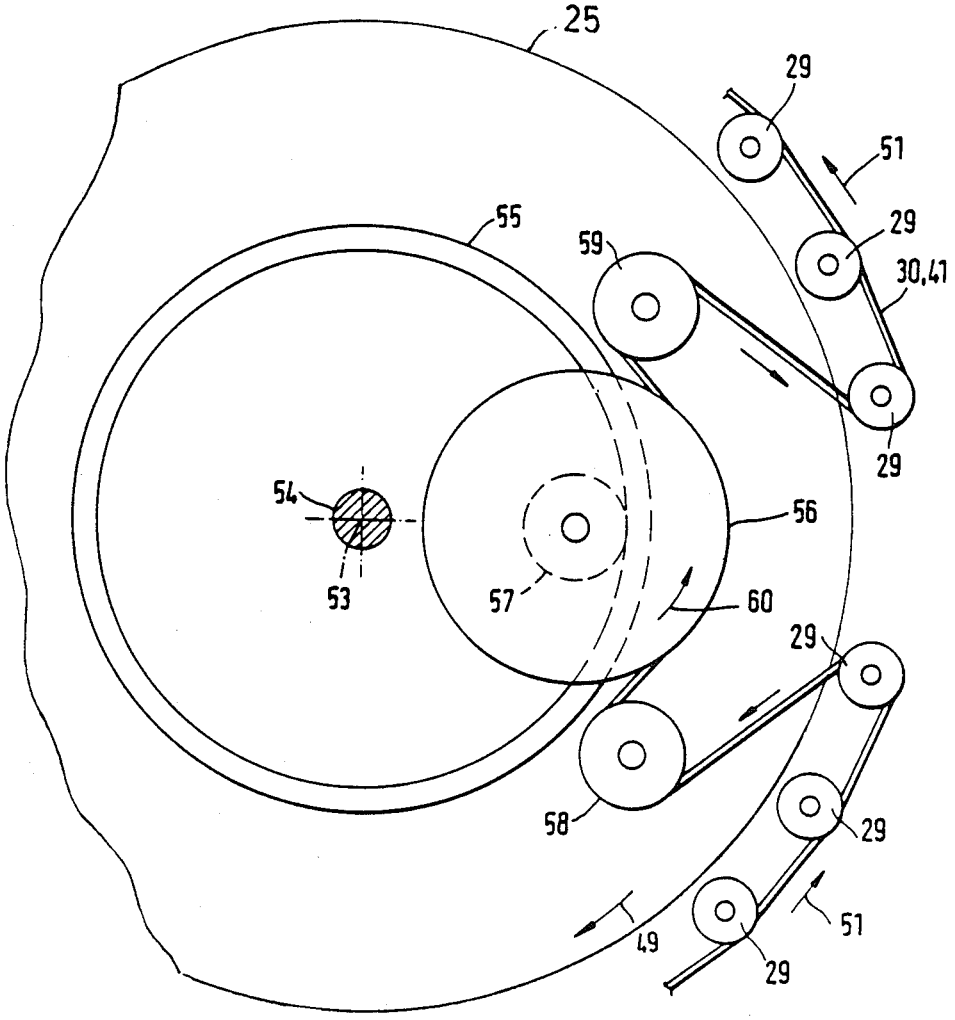
FIG. 27 shows a plan view of FIG. 26, but with additional drive, deflection and control means.
Figure 27A:
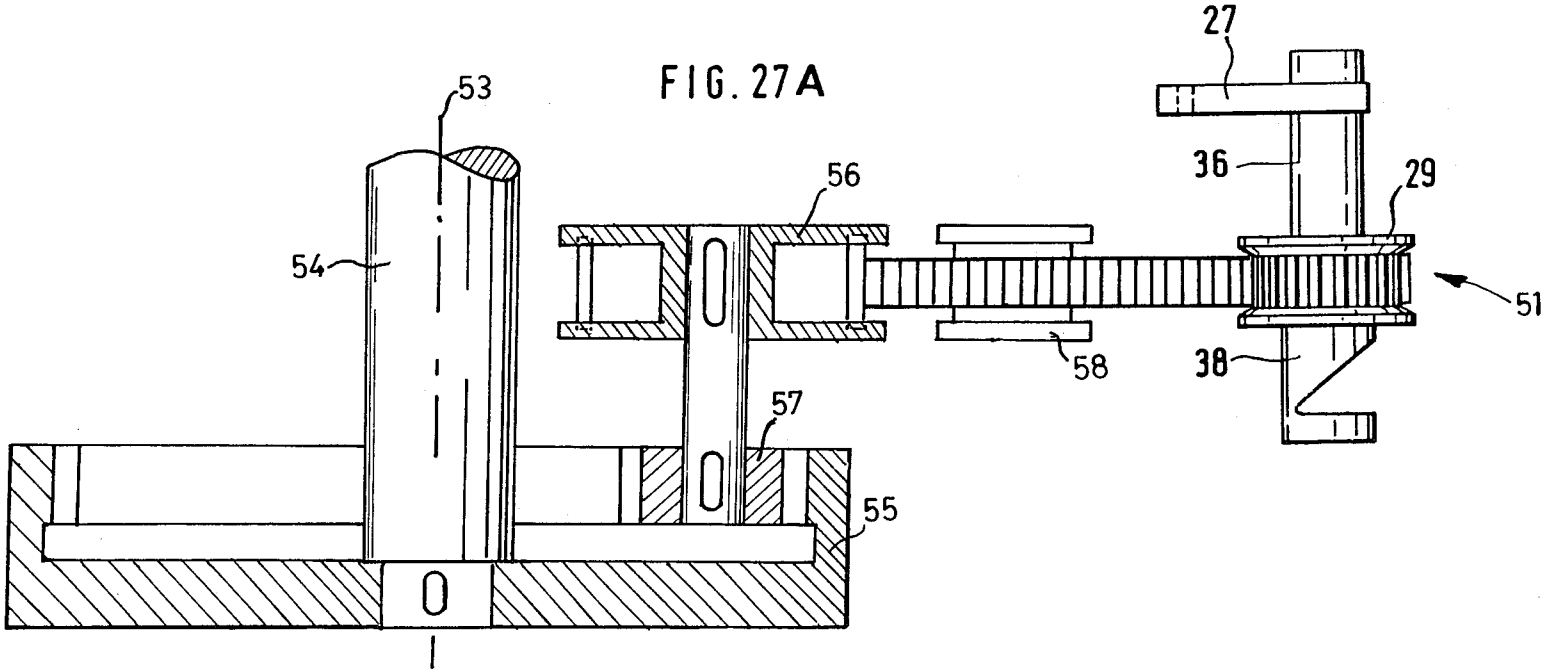
FIG. 27A shows a side view of FIG. 27.

In FIG. 27 there may be seen the vertical geometrical central axis 53 of the machine. On a coaxial carrier bar 54 a disc 55 hangs horizontally, which a first internal toothing (not shown) and does not rotate. A pin wheel 56 rotates with the disc 25 and has, connected fast in rotation with it on its under side, a second toothed wheel 57 which rolls with its external teeth on the internal teeth of the disc 55. Thus the pin wheel also rotates in the direction of the arrow 60. It a third toothed wheel with 72 external teeth, some of which mesh with teeth of the toothed belts 30, 41. So that the looping angle becomes greater, deflector pulleys 58, 59 are provided which naturally rotate together with the pin wheel 56. Since the teeth are on the other side of the toothed belts 30, 48, the deflector pulleys 58, 59 run on the smooth outer side of the toothed belts 30, 48. Then the toothed belts 30, 48 mesh with the toothed wheels 29. For the sake of simplicity these are not shown staggered here, and winders, holders etc. are lacking.

Figure 28:
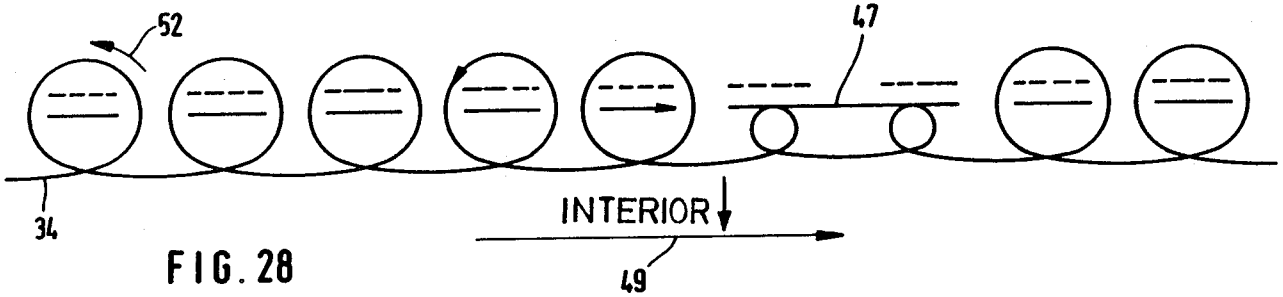
FIG. 28 shows a view from above, showing how selected needles are looped around and how a displacer arm device prevents the looping.

FIG. 28 shows from above what couse the winding thread 34 takes. It is seen that the winders rotate contrarily of the direction of the arrow 49, in the direction of the arrow 52. This direction leads to a more secure insertion than the opposite direction of rotation of the winders. Naturally the individual knitting systems lie on a circle and are here represented only extended.

According to FIG. 28 winding is being effected in the first five knitting systems. Thereafter the edge 47 of a displacer arm repels the winding thread 34. Here for the sake of simplicity the displacer arm 35 is illustrated so that it extends over two knitting systems. Thereafter winding is effected again on the 8th and 9th knitting systems.

Figure 29:
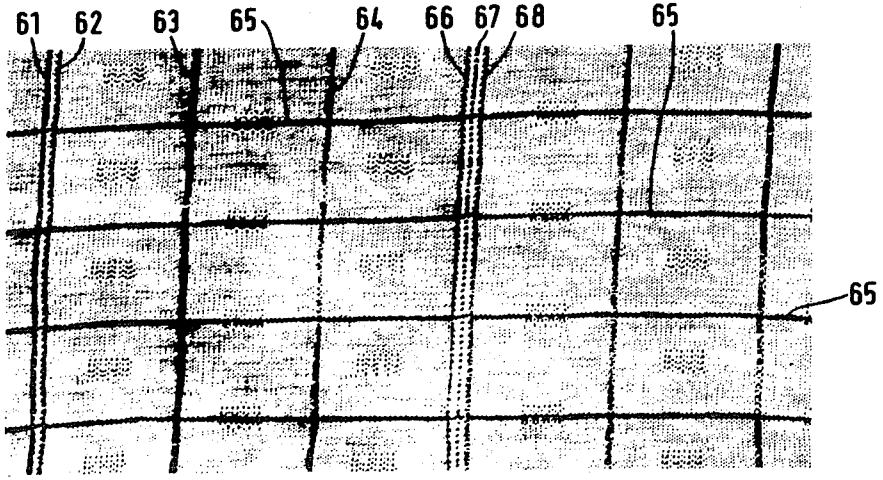
FIG. 29 shows a cloth produced according to the invention.

In the pattern according to FIG. 29 the wales 61, 62, 63, 64, 66, 67, 68 were produced by the invention. FIG. 29 shows the knitting from the right. The two wales 61, 62 are separated by a wale of the basic knitted fabric and then follow the wales 63, 64 as individual wales, and thereupon again the wales 66, 67, 68 lying closely side by side. The horizontal stitch rows 65 of other colour are produced in the usual manner in that a reel of yarn with yarn of other colour is used for the basic knitted fabric.

In the invention the winding devices also have a propellor effect so that fluff is removed and the machine remains cleaner. With the invention—as in the prior art—a winding thread can be inserted for several needles of a knitting system at the same time. However in the case of the invention the catching zone extends over a substantially greater range. If known systems achieve the object of accommodating 24 knitting systems on a machine with a diameter of 26 English inches, with the invention it is possible to accommodate 78 systems. Stitches can be formed and wound in every system.

I claim:

1. A device for inserting a wrap thread in a wrap insertion knitting machine having a center and a plurality of knitting needles with hooks in a plurality of successive knitting systems for the production of patterns extending in the longitudinal direction of a produced tubular fabric, said plurality of needles being movable in one direction in a circle about said center of said machine, comprising:

an inserting device for each wrap thread, said inserting device having a free end region and a passage for the wrap thread at said free end region, a number of bore devices arranged above said knitting needles, through which the wrap threads pass in the direction towards said inserting devices, which number corresponds to the number of wrap threads, said bore devices being movable in said one direction about said center of said machine, a rotating device for each said inserting device with which said passage is movable over the highest position of said needle hooks over an arcuate section, a control device for controlling the movement of said inserting device, and a displacer arm in some of said knitting systems which is positioned between said inserting device and needles situated beneath it and prevents insertion of the wrap thread into needles not to be wound, and the improvement wherein:

(a) each of said bore devices comprises a hollow shaft, the geometrical longitudinal axis of which is aligned from above with said circle of needles, (b) said control device comprises a toothed belt, (c) said rotating device comprises a toothed wheel constantly rotating in a single direction guided by said hollow shaft, said wheel meshing with said toothed belt and being rotated without slip by said toothed belt, (d) said inserting device for each wrap thread comprises a small bar having an upper end firmly connected with said wheel and a lower free end protruding towards said needles, (e) said lower free end has means defining said passage, said means being situated at a lateral distance from said geometrical longitudinal axis of said hollow shaft, and (f) viewed towards said center of said machine, the direction of rotation of said wheels and said inserting devices connected therein is opposite to the direction of movement of said needles about said center of said machine.

2. Device according to claim 1, wherein each of said needles has a geometrical longitudinal axis and said geometrical longitudinal axis of said hollow shaft stands vertically and is aligned with the geometrical longitudinal axis of said needles.

3. Device according to claim 1, wherein said geometrical longitudinal axis of said hollow shaft—neglecting tolerances—is aligned with the back of said needles.

4. Device according to claim 1, comprising a plurality of toothed wheels situated at the same level and driven by said toothed belt, which extends externally of said toothed wheels.

5. Device according to claim 1, comprising a plurality of toothed wheels staggered in height position and as many of said toothed belts as there are height positions driving said toothed wheels.

6. Device according to claim 5, comprising two height positions, each wheel of odd number being arranged in a first height position and each wheel of even number being arranged in a second height position.

7. Device according to claim 1, comprising a plurality of wheels, the geometrical longitudinal axes of which all lie in one common circular cylinder.

8. Device according to claim 7, in which said geometrical longitudinal axes of said hollow shafts are parallel.

9. Device according to claim 1, wherein said control device comprises a first toothed wheel fixed to the frame of said wrap insertion knitting machine and coaxial with the central axis of said machine, and a second toothed wheel that rotates with said wheels guided by said hollow shafts, meshes with said first toothed wheel, and drives said wheels guided by said hollow shafts.

10. Device according to claim 9, wherein said first toothed wheel has an internal toothing, and a third toothed wheel is secured coaxially with said second toothed wheel, is larger than said second toothed wheel, and meshes with said toothed belt.

11. Device according to claim 10, comprising tensioner wheels increasing the looping angle for said toothed belt on said third toothed wheel, provided on both sides of said third toothed wheel.

12. Device according to claim 1, wherein said hollow shafts are secured to a common assembly base, said hollow shafts being adjustably secured on said common assembly base to align said geometrical longitudinal axes of said hollow shafts from above with the highest position of said needles in each knitting system at the middle position or to lead or to lag said highest position of said needles in each knitting system.

13. Device according to claim 1 wherein said means defining said passage comprises means defining an eye at said lower free end of said small bar.

14. Device according to claim 1, where said small bar is selected from one of the group comprising a steel wire and a fine casting.

15. Device according to claim 13, wherein said eye stands substantially horizontally and said bar is externally connected with said means defining said eye.

16. Device according to claim 13, wherein said means defining said eye is a separate thread guide component of ceramics and the like.

17. Device according to claim 13, wherein said bar in its lower region comprises a mounting for said means defining said eye.

18. A device for inserting a wrap thread in a wrap insertion knitting machine having a center and a plurality of knitting needles with hooks in a plurality of successive knitting systems for the production of patterns extending in the longitudinal direction of a produced tubular fabric, said plurality of needles being movable in one direction in a circle about said center of said machine, comprising:

an inserting device for each wrap thread, said inserting device having a free end region and a passage for the wrap thread at said free end region, a number of bore devices arranged above said knitting needles, through which the wrap threads pass in the direction towards said inserting devices, which number corresponds to the number of wrap threads, said bore devices being movable in said one direction about said center of said machine, a rotating device for each said inserting device with which said passage is movable over the highest position of said needle hooks over an arcuate section, a control device for controlling the movement of said inserting device, and a displacer arm in some of said knitting systems which is positioned between said inserting device and needles situated beneath it and prevents insertion of the wrap thread into needles not to be wound, and the improvement wherein:

(a) each of said bore devices comprises a hollow shaft, the geometrical longitudinal axis of which is aligned from above with said circle of needles, (b) said rotating device comprises a wheel constantly rotating in a single direction guided by said hollow shaft, said wheel being rotated without slip by said control device, (c) said inserting device for each wrap thread comprises a small bar having an upper end firmly connected with said wheel and a lower free end protruding towards said needles, (d) said lower free end has means defining said passage, said means being situated at a lateral distance from said geometrical longitudinal axis of said hollow shaft, (e) said control device comprises a first toothed wheel fixed to the frame of said wrap insertion knitting machine and coaxial with the central axis of said machine and a second toothed wheel that rotates with said wheels guided by said hollow shafts, meshes with said first toothed wheel, and drives said wheels guided by said hollow shafts, and (f) viewed towards said center of said machine, the direction of rotation of said wheels and said inserting devices connected thereto is opposite to the direction of movement of said needles about said center of said machine.

* * * * *